US010234815B2

(12) United States Patent
Nakayashiki

(10) Patent No.: US 10,234,815 B2
(45) Date of Patent: Mar. 19, 2019

(54) ELECTRODE AND IMAGE FORMING APPARATUS INCLUDING THE SAME

(71) Applicant: CANON KABUSHIKI KAISHA, Tokyo (JP)

(72) Inventor: Yuji Nakayashiki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/899,961

(22) Filed: Feb. 20, 2018

(65) Prior Publication Data

US 2018/0246461 A1 Aug. 30, 2018

(30) Foreign Application Priority Data

Feb. 27, 2017 (JP) ..... 2017-034886
Nov. 15, 2017 (JP) ..... 2017-220208

(51) Int. Cl.
*G03G 15/00* (2006.01)
*G03G 15/02* (2006.01)
*H01R 13/24* (2006.01)

(52) U.S. Cl.
CPC ..... *G03G 15/80* (2013.01); *G03G 15/0283* (2013.01); *H01R 13/2421* (2013.01); *G03G 2221/163* (2013.01); *G03G 2221/166* (2013.01); *G03G 2221/1606* (2013.01); *G03G 2221/1815* (2013.01)

(58) Field of Classification Search
CPC ..... G03G 15/80
USPC ..... 399/89
See application file for complete search history.

(56) References Cited

U.S. PATENT DOCUMENTS 8,401,418 B2 * 3/2013 Souda ..... G03G 21/1867 399/112
2011/0262173 A1 * 10/2011 Souda ..... G03G 21/16 399/89
2014/0376943 A1 * 12/2014 Nishimura ..... G03G 15/80 399/90
2014/0376958 A1 * 12/2014 Souda ..... G03G 21/1619 399/107

FOREIGN PATENT DOCUMENTS

JP 2002-124231 A 4/2002
JP 2013-148835 A 8/2013

* cited by examiner

*Primary Examiner* — Quana M Grainger
(74) *Attorney, Agent, or Firm* — Canon U.S.A., Inc. IP Division

(57) ABSTRACT

A contact point end portion of a second ring connected to a first ring portion on a power reception portion side protrudes further in the direction of a power reception portion than a contact point end portion of the first ring connected to a spring portion on a power reception portion side.

14 Claims, 7 Drawing Sheets

ELECTRODE AND IMAGE FORMING APPARATUS INCLUDING THE SAME

BACKGROUND OF THE INVENTION

Field of the Invention

The present disclosure generally relates to an electrode for use in an image forming apparatus.

Description of the Related Art

In Japanese Patent Application Laid-Open No. 2013-148835, an electrode for use in an image forming apparatus is composed of a spring portion formed cylindrically by winding a wire rod into a helix. In an annular electrical contact portion provided on one end side in the axial direction of the spring portion, a ring portion is provided, which is obtained by winding the wire rod at least twice about a center line along a direction intersecting the axial direction of the spring portion.

Japanese Patent Application Laid-Open No. 2002-124231 discusses an electrode for use in a contact assembly component for a battery electrode terminal. This electrode includes a spring portion obtained by winding a wire rod into a coil (a helix), and a contact point portion formed by changing the direction of the wire rod by 90° with respect to the axial direction of the spring portion and annularly winding the wire rod twice. With this configuration, the contact point portion comes into contact with a contact point target portion at two points. This results in a structure highly reliable in electrical conduction properties.

However, in Japanese Patent Application Laid-Open No. 2013-148835 and Japanese Patent Application Laid-Open No. 2002-124231, a ring portion forming a contact point portion, which is obtained by winding a wire rod twice, includes two contact portions placed at the same height position in the state where the contact portions are in contact with each other, and the ring portion is not in contact with a contact point target portion. Thus, when the contact angle between the contact point portion and the contact point target portion is relatively inclined, such as when the contact point target portion is inclined, only one of the contact portions is in contact with the contact point target portion. Thus, the ring portion becomes less reliable in electrical conduction properties as an electrical contact point.

SUMMARY OF THE INVENTION

Aspects of the present disclosure are directed to providing an electrode in which, even if the relative angle between the electrode and a contact point target portion changes, electrical contact portions are in contact with the contact point target portion reliably at two points.

According to an aspect of the present disclosure, an electrode includes an elastically deformable spring portion formed cylindrically by winding a conductive wire rod into a helix, and a ring portion provided on one end side in a first axial direction of the spring portion and obtained by annularly winding the conductive wire rod in a second axial direction intersecting the first axial direction, wherein the ring portion includes, in the second axial direction, a first ring connected to the spring portion, and a second ring connected to the first ring, wherein in a state where the ring portion is not in contact with a contact point target, a contact point end portion of the second ring on the contact point target side protrudes further in a direction of the contact point target than a contact point end portion of the first ring on the contact point target side, and wherein in a state where the second ring is in contact with the contact point target, and the spring portion is compressed in the first axial direction, the first ring and the second ring come into contact with the contact point target.

Further features of the present disclosure will become apparent from the following description of exemplary embodiments with reference to the attached drawings.

DESCRIPTION OF THE EMBODIMENTS

With reference to the drawings, exemplary embodiments of an electrode according to the present disclosure and an image forming apparatus including the electrode will be specifically described.

First, with reference to FIGS. 1 to 6C, the configuration of a first exemplary embodiment of the image forming apparatus including the electrode is described.

<Image Forming Apparatus>

Figure 1:
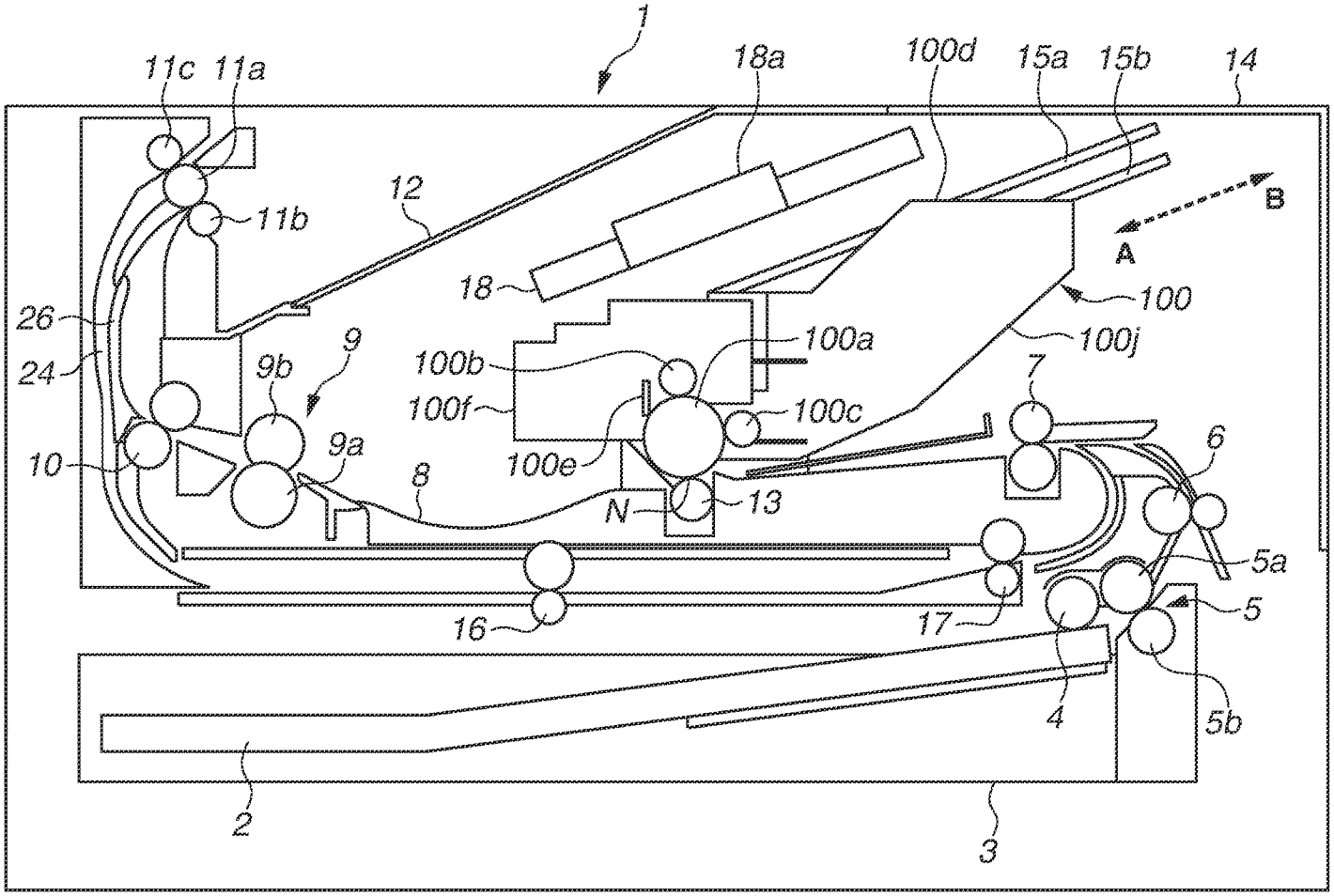
FIG. 1 is a cross-sectional view illustrating a configuration of an image forming apparatus.
Figure 2:
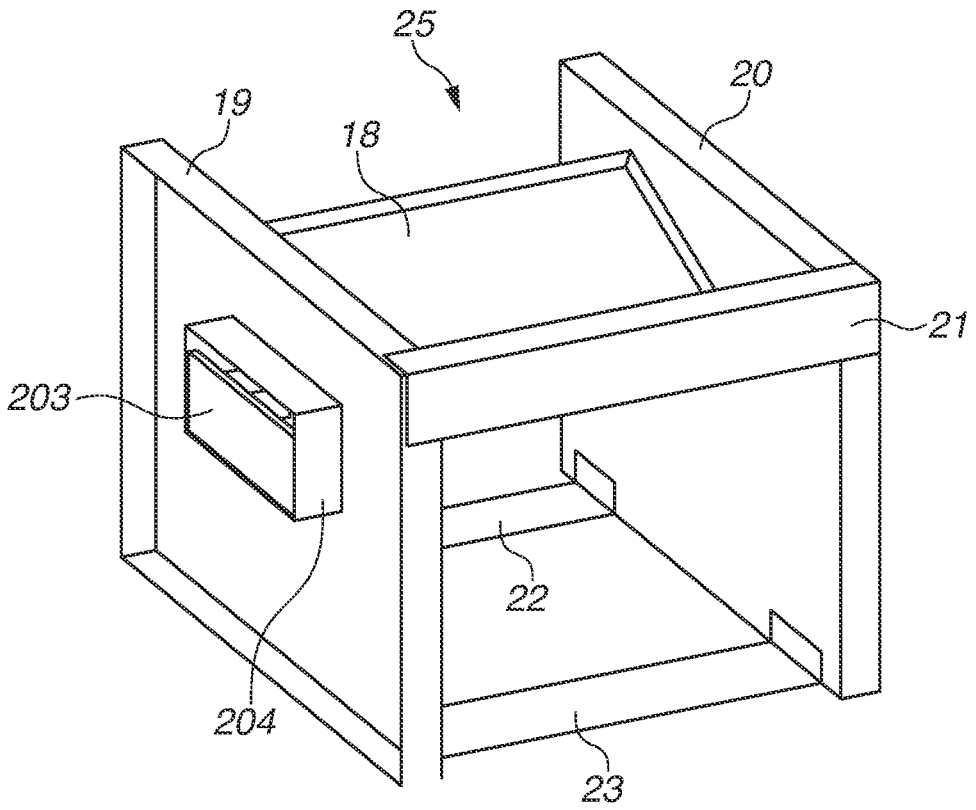
FIG. 2 is a perspective view illustrating a frame configuration of the image forming apparatus.

With reference to FIG. 1, the configuration of an image forming apparatus 1 including the electrode is described. In the image forming apparatus 1 illustrated in FIG. 1, a process cartridge 100 is provided to be attachable to and detachable from the image forming apparatus 1. The image forming apparatus 1 according to the present exemplary embodiment is an example of a laser beam printer using an electrophotographic method.

In the image forming apparatus 1 illustrated in FIG. 1, a photosensitive drum 100*a* as an image bearing member composed of a cylindrical electrophotographic photosensitive member rotates clockwise in FIG. 1. The surface of the photosensitive drum 100*a* rotating clockwise in FIG. 1 is uniformly charged by a charging roller 100*b* as a charging unit. The uniformly charged surface of the photosensitive drum 100*a* is irradiated with laser light based on image information by a laser scanner 18*a* as an exposure unit, which is provided in an optical bench 18. Consequently, an electrostatic latent image is formed on a photosensitive layer on the surface of the photosensitive drum 100*a*.

To the electrostatic latent image formed on the surface of the photosensitive drum 100*a*, toner as a developer is supplied by a developing roller 100*c* as a developer bearing member, which is provided in a developing device 100*j* as a developing unit, thereby developing the electrostatic latent image as a toner image. In synchronization with the formation of the toner image on the surface of the photosensitive drum 100*a*, a recording material 2 stored in a feed cassette 3 is fed.

The recording material 2 stored in the feed cassette 3 is taken out by a pickup roller 4 and then sent to a separation unit 5, which is formed of a feed roller 5*a* and a separation roller 5*b*. The separation unit 5 separates and feeds a single recording material 2 at the top position among recording materials 2 stacked in the feed cassette 3. Then, the recording material 2 is nipped and conveyed by conveying rollers 6, and a front end portion of the recording material 2 is hit against a nip portion between registration rollers 7 at rest, thereby correcting the skew of the recording material 2.

Then, the registration rollers 7 rotate at a predetermined timing, and the recording material 2 is nipped and conveyed by the registration rollers 7 and is conveyed to a transfer nip portion N, which is formed by the photosensitive drum 100*a* and a transfer roller 13 as a transfer unit. A transfer bias is applied to the transfer roller 13 from a transfer bias power supply (not illustrated), thereby transferring the toner image formed on the surface of the photosensitive drum 100*a* onto the recording material 2. Residual toner remaining on the surface of the photosensitive drum 100*a* after the transfer is scraped and removed by a cleaning blade 100*e* as a cleaning unit, which is provided in a cleaning container 100*f*.

In the transfer nip portion N, the recording material 2 onto which the toner image has been transferred is nipped and conveyed by the surface of the photosensitive drum 100*a* and the transfer roller 13 and is conveyed to a fixing device 9 as a fixing unit while a lower surface of the recording material 2 is guided by a conveyance guide 8. In the fixing device 9, a pressure roller 9*a* and a heating unit 9*b* are provided. While the recording material 2 passing through the fixing device 9 is nipped and conveyed by the pressure roller 9*a* and the heating unit 9*b*, the recording material 2 is heated and pressurized, whereby the toner image is heat-fused and heat-fixed to the recording material 2.

The recording material 2 to which the toner image has been heat-fixed is nipped and conveyed by the pressure roller 9*a* and the heating unit 9*b* and is sent to rear conveying rollers 10. In a case where an image is to be formed only on one surface of the recording material 2, the recording material 2 is nipped and conveyed by the rear conveying rollers 10. Then, the recording material 2 is discharged from inside an image forming apparatus 1 main body along a conveyance guide 26 by a discharge roller pair formed of a discharge roller 11*a* and a driven roller 11*b* and stacked on a discharge tray 12.

In a case where an image is also to be formed on the back surface of the recording material 2, the position of the conveyance guide 26 is switched by a conveying path switching unit (not illustrated), and the recording material 2 is nipped and conveyed by the rear conveying rollers 10. Then, along the conveyance guide 26 having moved counterclockwise in FIG. 1, the recording material 2 is nipped by a reverse roller pair formed of the discharge roller 11*a* and a driven roller 11*c*.

Then, after a rear end portion in the moving direction of the recording material 2 passes through the conveyance guide 26, the conveyance guide 26 moves clockwise in FIG. 1. Then, the rotational direction of the discharge roller 11*a* is reversed. Consequently, the recording material 2 nipped by the discharge roller 11*a* and the driven roller 11*c* is conveyed along a reverse path 24. Then, the recording material 2 is nipped and conveyed by conveying rollers 16 and 17, and the front and back surfaces of the recording material 2 are reversed. Then, the front end portion of the recording material 2 is hit against the nip portion between the registration rollers 7 at rest again, thereby correcting the skew of the recording material 2.

Then, the registration rollers 7 rotate at a predetermined timing, and similarly to the first surface, in the transfer nip portion N, a toner image formed on the surface of the photosensitive drum 100*a* is transferred onto the second surface of the recording material 2 by the transfer roller 13. Then, the recording material 2 passes through the conveyance guide 8, the fixing device 9, and the rear conveying rollers 10, is guided by the conveyance guide 26, and is discharged onto the discharge tray 12 by the discharge roller pair formed of the discharge roller 11*a* and the driven roller 11*b*.

<Cartridge>

The process cartridge 100 (a cartridge) is provided to be attachable to and detachable from the image forming apparatus 1 main body in the directions A and B of the double-headed arrow in FIG. 1 along guide members 15*a* and 15*b*, which are provided within the image forming apparatus 1 main body, by opening an opening/closing door 14, which is provided to be openable and closable in the image forming apparatus 1 main body.

The process cartridge 100 includes the photosensitive drum 100*a* as the image bearing member and at least one image forming process unit. The process cartridge 100 according to the present exemplary embodiment includes the photosensitive drum 100*a* as the image bearing member. Further, the process cartridge 100 includes the charging roller 100*b* as the charging unit for uniformly charging the surface of the photosensitive drum 100*a*.

Further, the process cartridge 100 includes the developing device 100*j* as the developing unit for supplying toner as a developer to an electrostatic latent image formed on the surface of the photosensitive drum 100*a*. Further, the process cartridge 100 includes a developing container 100*d*, which stores toner as a developer, and the developing roller 100*c* as the developer bearing member. Further, the cleaning container 100*f* and the cleaning blade 100*e* as the cleaning unit are provided in an integrated manner. The laser scanner 18*a* and the transfer roller 13 are provided in the image forming apparatus 1 main body.

The surface of the photosensitive drum 100*a* is irradiated, through an aperture provided in a frame member forming the process cartridge 100, with laser light according to image information emitted from the laser scanner 18*a*. The surface of the photosensitive drum 100*a*, which is rotatably provided in the process cartridge 100, is covered by a shutter member (not illustrated) provided in the frame member. In conjunction with the operation in which a user attaches the process cartridge 100 to a predetermined position in the image forming apparatus 1 main body, the shutter member (not illustrated) moves and is opened, and the surface of the photosensitive drum 100*a* is exposed and opposed to the surface of the transfer roller 13.

In the image forming apparatus 1 main body, the opening/closing door 14, which is provided to be openable and closable relative to the image forming apparatus 1 main body by pivoting about a pivotal fulcrum (not illustrated), and the guide members 15*a* and 15*b*, which guide the process cartridge 100, are provided. When the process cartridge 100 is attached to or detached from the image forming apparatus 1 main body, the movement of the process cartridge 100 is restricted in the directions A and B of the double-headed arrow in FIG. 1 by the guide members 15*a* and 15*b*.

<Electrode>

Next, with reference to FIGS. 2 to 6C, a description is given of the configuration of an electrode 200, which supplies necessary power from the image forming apparatus 1 main body to the process cartridge 100. An apparatus frame 25 of the image forming apparatus 1 main body illustrated in FIG. 2 includes the optical bench 18, left and right side plates 19 and 20, which are placed to sandwich bottom plates 22 and 23 from both sides, and an upper stay 21, which reinforces upper portions of the left and right side plates 19 and 20 by bridging the upper portions.

Figure 3:
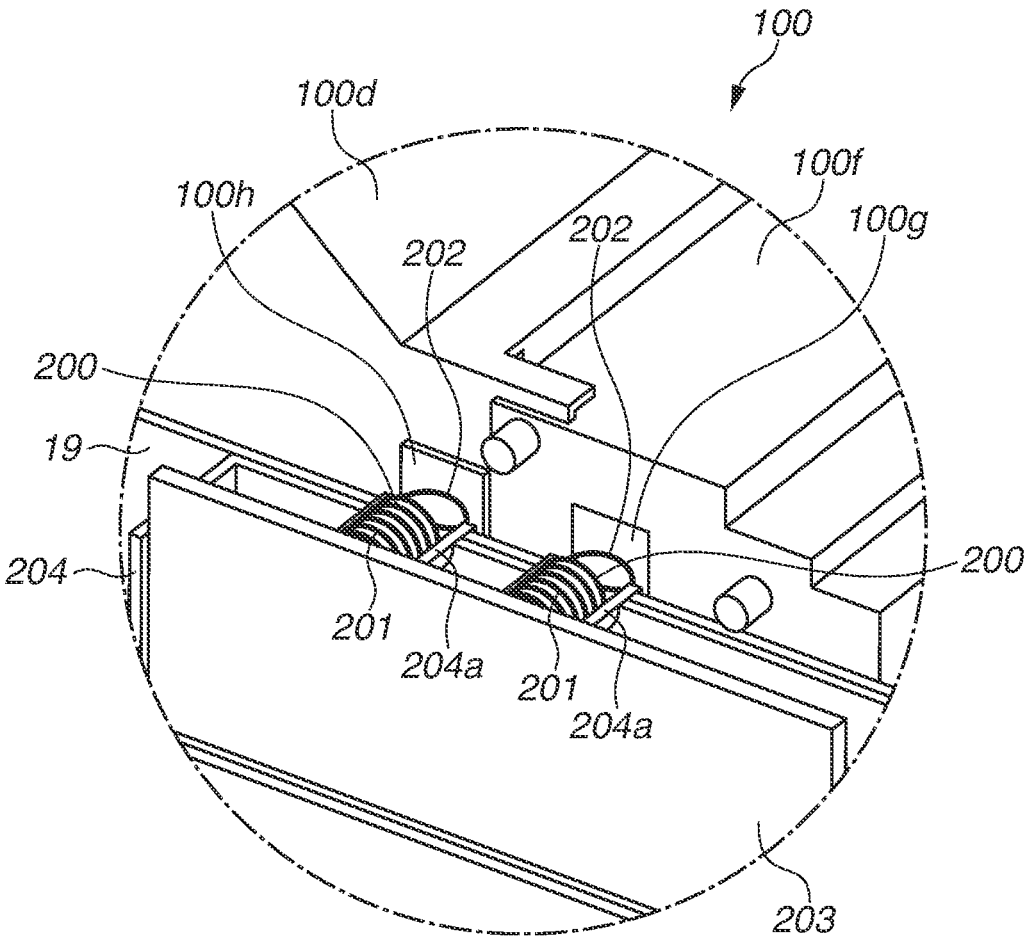
FIG. 3 is a perspective view illustrating a configuration of a ring portion of an electrode according to a first exemplary embodiment in a state where a process cartridge is inserted into an image forming apparatus main body so that an image can be formed.
Figure 4:
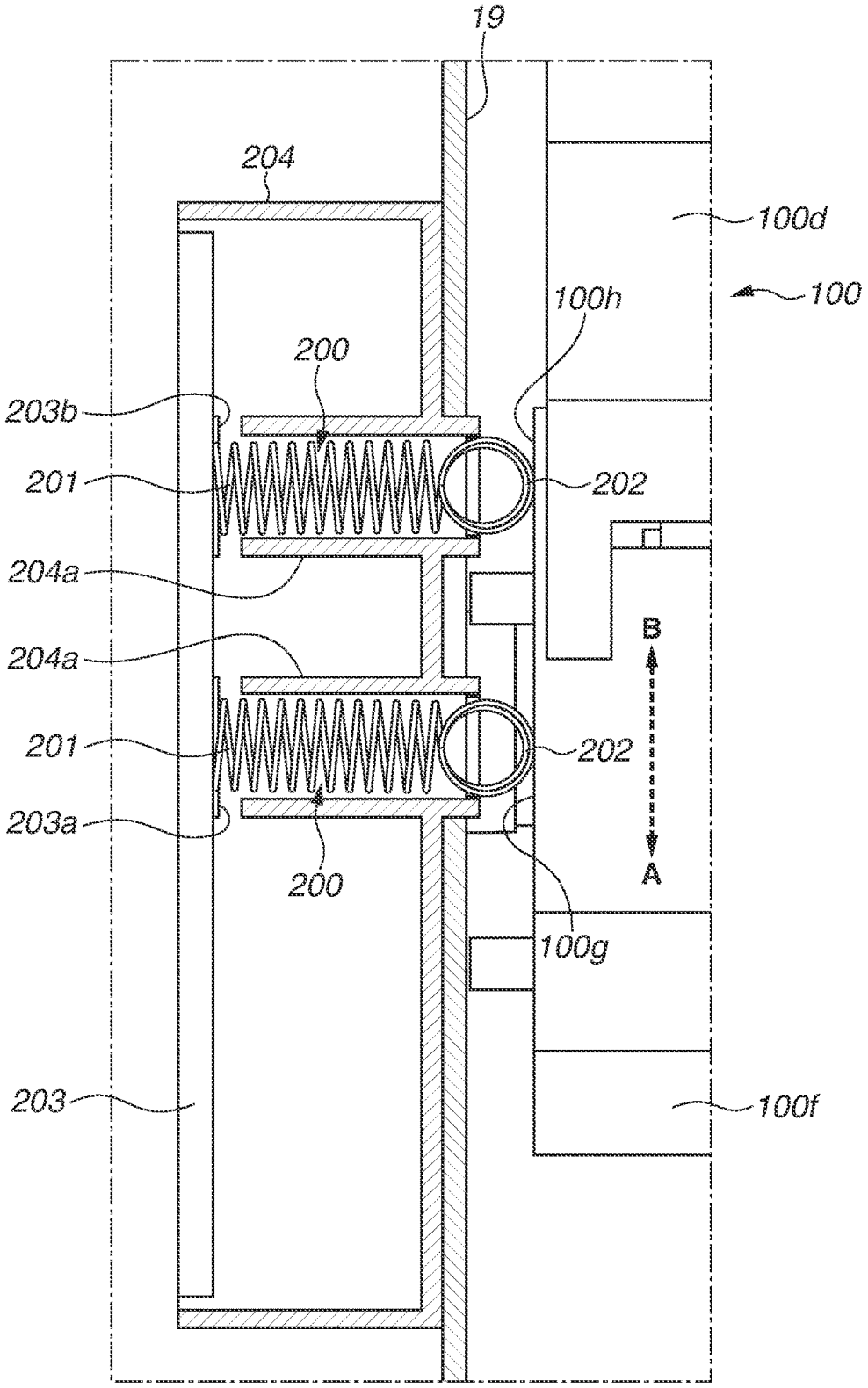
FIG. 4 is a top cross-sectional view illustrating the configuration of the ring portion of the electrode according to the first exemplary embodiment in the state where the process cartridge is inserted into the image forming apparatus main body so that an image can be formed.

As illustrated in FIG. 4, outside the left side of plate 19 (the left side in FIG. 4), a holder portion 204 is provided, which supports a high-pressure board 203, which supplies power from the image forming apparatus 1 main body to the process cartridge 100. The high-pressure board 203, which is supported by the holder portion 204, transforms a voltage generated by a power supply board (not illustrated) and supplies power to power reception portions 100*g* and 100*h*, which are provided in the process cartridge 100, via a pair of electrodes 200 illustrated in FIGS. 3 and 4.

<Contact Point Target Portion>

As illustrated in FIGS. 3 and 4, on a side surface in an end portion in the longitudinal direction of the developing container 100*d*, which is composed of the frame member of the process cartridge 100, the power reception portion 100*h* is provided, which receives developing bias power to be supplied to the developing roller 100*c* as the developer bearing member.

Further, on a side surface in an end portion in the longitudinal direction of the cleaning container 100*f*, which is composed of the frame member of the process cartridge 100, the power reception portion 100*g* is provided, which receives charging bias power to be supplied to the charging roller 100*b* as the charging unit. Outside the left side plate 19 illustrated in FIG. 4 (the left side in FIG. 4), the holder portion 204 is provided. Inside the holder portion 204, a pair of cylindrical guide portions 204*a* are provided.

Inside the pair of cylindrical guide portions 204*a*, electrodes 200 are slidably provided. Each electrode 200 includes an elastically deformable spring portion 201, which is formed cylindrically by winding a conductive wire rod into a coil (a helix). Further, a ring portion 202 is provided on one end side (the upper side in FIGS. 5A and 5B) in a first axial direction of the spring portion 201. The ring portion 202 is formed by annularly winding the conductive wire rod in a direction (the left-right direction in FIG. 5B) intersecting the first axial direction (the up-down direction in FIGS. 5A and 5B) of the spring portion 201 as a second axial direction.

The ring portion 202 is obtained by changing the direction of the wire rod on the one end side in the first axial direction of the spring portion 201 by 90° and placing the second axial direction (the left-right direction in FIG. 5B) along a direction approximately orthogonal to the first axial direction (the up-down direction in FIGS. 5A and 5B) of the spring portion 201. The ring portion 202 is formed by annularly winding the wire rod twice. The ring portion 202 includes a first ring portion 202*a*, which is connected to the spring portion 201 in the second axial direction (the left-right direction in FIG. 5B), and a second ring portion 202*b*, which is connected to the first ring portion 202*a*.

<Difference in Structure Between First and Second Ring Portions>

Figure 5A:
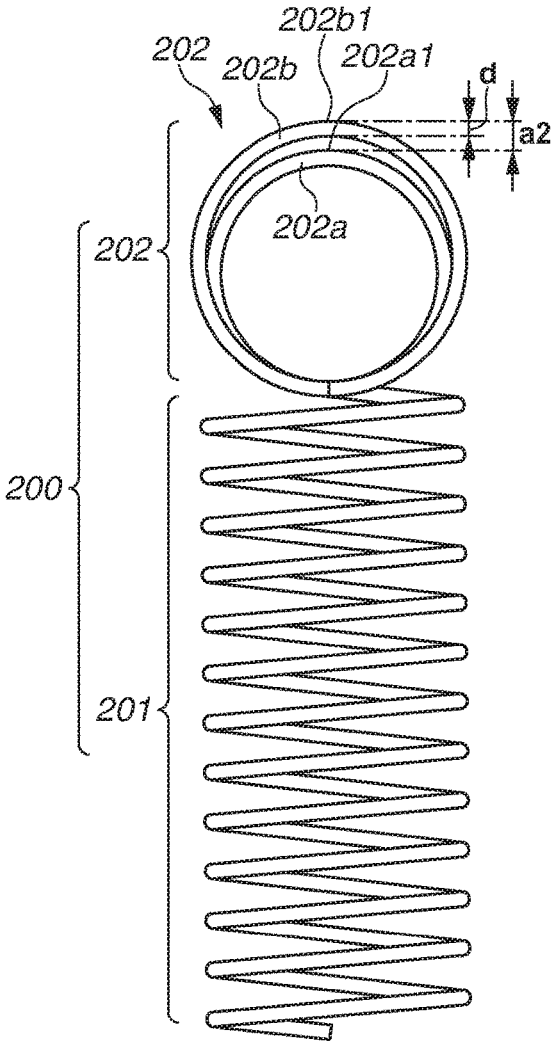
FIG. 5A is a front view illustrating a configuration of the electrode according to the first exemplary embodiment.
Figure 5B:
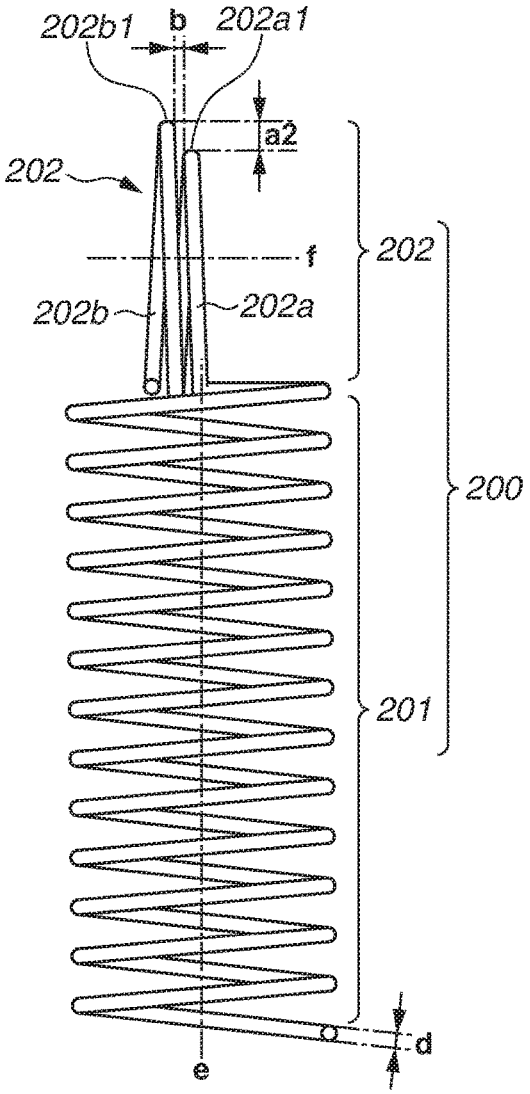
FIG. 5B is a side view illustrating the configuration of the electrode according to the first exemplary embodiment.

Consideration is given to the state where as illustrated in FIGS. 5A and 5B, the ring portion 202 is not in contact with a contact point target portion such as the power reception portion 100*g*, which supplies charging bias power to the charging roller 100*b*, or the power reception portion 100*h*, which supplies developing bias power to the developing roller 100*c*. In this state, the positions of the furthest portions (contact point end portions 202*a*1 and 202*b*1) of the first and second ring portions 202*a* and 202*b* from the spring portion 201 are different from each other in the first axial direction (a direction along a center line e) of the spring portion 201.

That is, consideration is given to the position of the furthest portion (the contact point end portion 202*b*1) of the second ring portion 202*b* from the spring portion 201. This position protrudes further along the first axial direction (the direction along the center line e) of the spring portion 201 than the position of the furthest portion (the contact point end portion 202*a*1) of the first ring portion 202*a* from the spring portion 201 in the first axial direction (the direction along the center line e) of the spring portion 201 by the amount of protrusion a.

As illustrated in FIG. 4, the pair of electrodes 200 is pressed between power feeding units 203*a* and 203*b*, which are provided in the high-pressure board 203 supported by the holder portion 204, and the power reception portions 100*g* and 100*h*, which are provided in the process cartridge 100. Restoring forces (expanding forces) act by the elastic forces of the spring portions 201 and the ring portions 202. Consequently, the power feeding units 203*a* and 203*b*, which are provided in the high-pressure board 203, and the power reception portions 100*g* and 100*h*, which are provided in the process cartridge 100, function as contact points via the pair of electrodes 200 by ensuring electrical conduction.

Consideration is given to the state where as illustrated in FIG. 4, the ring portions 202 of the respective electrodes 200 are in contact with the power reception portion 100*g* (a contact point target portion), which supplies charging bias power to the charging roller 100*b*, and the power reception portion 100*h* (a contact point target portion), which supplies developing bias power to the developing roller 100*c*. In this state, contact portions of these portions are exposed to outside. This enables the user to visually confirm contact states.

The cleaning container 100*f* illustrated in FIGS. 1 and 3 is configured as a first cartridge including at least the photosensitive drum 100*a* (the image bearing member) and the charging roller 100*b* (the charging unit). Further, the developing container 100*d* is configured as a second cartridge. The cleaning container 100*f* (the first cartridge) and the developing container 100*d* (the second cartridge) are provided to be attachable to and detachable from the image forming apparatus 1 main body. In this case, the configuration may be such that the cleaning container 100*f* (the first cartridge) and the developing container 100*d* (the second cartridge) are provided to be independently attachable to and detachable from the image forming apparatus 1 main body.

As illustrated in FIGS. 3 and 4, the image forming apparatus 1 includes two electrodes 200. The ring portion 202 of a first electrode 200, which is illustrated below in FIG. 4, comes into contact with the contact point target portion composed of the power reception portion 100*g*, which receives power to be supplied to the charging roller 100*b* (the charging unit), which is provided in the cleaning container 100*f* (the first cartridge).

On the other hand, the ring portion 202 of a second electrode 200, which is illustrated above in FIG. 4, comes into contact with the contact point target portion composed of the power reception portion 100*h*, which receives power to be supplied to the developing roller 100*c* (the developer bearing unit), which is provided in the developing container 100*d* (the second cartridge).

As illustrated in FIGS. 5A and 5B, each electrode 200 includes the elastically deformable spring portion 201, which is formed cylindrically (into a coil) by winding a conductive wire rod into a helix. Further, the ring portion 202 is provided in one end portion (the upper side in FIGS. 5A and 5B) in the first axial direction (the up-down direction in FIGS. 5A and 5B) of the spring portion 201.

The ring portion 202 is formed by changing the direction of the wire rod in the one end portion of the spring portion 201 by 90° and annularly winding the wire rod in the second axial direction placed along a direction (the left-right direction in FIG. 5B) orthogonal to the first axial direction of the spring portion 201.

In this case, as illustrated in FIG. 5B, the first axial direction of the spring portion 201 is the direction along the center line e of the cylindrical (coil-shaped) member formed by winding the conductive wire rod into a helix. Further, the second axial direction of the ring portion 202 is a direction along a center line f of the first ring portion 202*a*, which is composed of the ring-shaped (coil-shaped) member formed by changing the direction of the wire rod in the one end portion of the spring portion 201 by 90° and winding the wire rod into a helix first. The center line (not illustrated) of the second ring portion 202*b* is at a position shifted from the center line f of the first ring portion 202*a*.

As illustrated in FIG. 5B, the center line f along the second axial direction (the left-right direction in FIG. 5B) of the ring portion 202 intersects the center line e along the first axial direction (the up-down direction in FIG. 5B) of the spring portion 201. It is desirable that the center line e along the first axial direction and the center line f along the second axial direction should be designed to have an orthogonal relationship.

The ring portion 202 includes the first ring portion 202*a*, which is connected to the wire rod in the one end portion (the upper side in FIG. 5B) of the first axial direction (the up-down direction in FIG. 5B) of the spring portion 201, and the second ring portion 202*b*, which is connected to the first ring portion 202*a*.

Consideration is given to the state where as illustrated in FIGS. 5A and 5B, the power reception portion 100*g* or 100*h* as each contact point target portion, which is provided in the process cartridge 100, is not in contact with the ring portion 202 of the electrode 200. In this state, consideration is given to the contact point end portion 202*a*1 of the first ring portion 202*a* on the process cartridge 100 side (the contact point target portion side) and the contact point end portion 202*b*1 of the second ring portion 202*b* on the process cartridge 100 side (the contact point target portion side). As illustrated in FIGS. 5A and 5B, the contact point end portion 202*b*1 of the second ring portion 202*b* protrudes further in the direction (the up direction in FIGS. 5A and 5B) of the process cartridge 100 (the contact point target portion) than the contact point end portion 202*a*1 of the first ring portion 202*a* by the amount of protrusion a2.

The amount of protrusion a2 of the contact point end portion 202*b*1 of the second ring portion 202*b* relative to the contact point end portion 202*a*1 of the first ring portion 202*a* is set to be larger than a wire diameter d of the steel wire rod (the outer diameter of the wire rod) forming the electrode 200. Further, a space b, which is provided between the first and second ring portions 202*a* and 202*b* in the second axial direction (the left-right direction in FIG. 5B) of the ring portion 202, is set to be larger than the wire diameter d of the steel wire rod (the outer diameter of the wire rod) forming the electrode 200

Figure 6A:
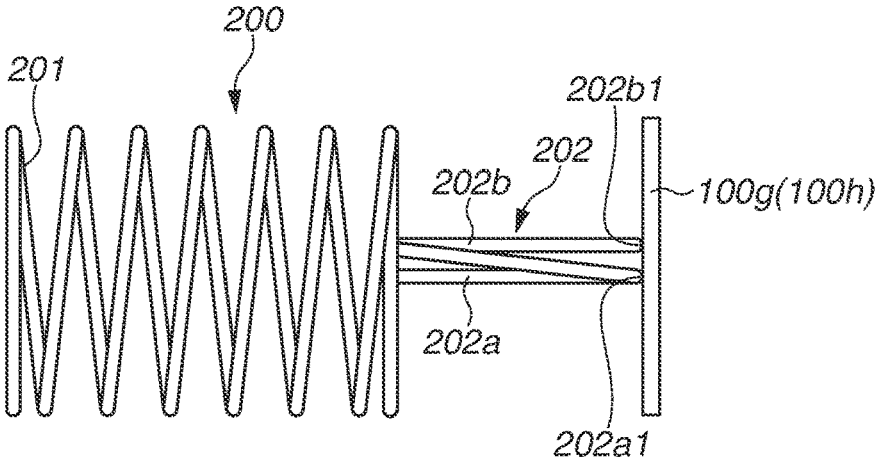
FIGS. 6A, 6B, and 6C are cross-sectional views illustrating a contact state between the ring portion of the electrode according to the first exemplary embodiment and a power reception portion of the process cartridge.
Figure 6B:
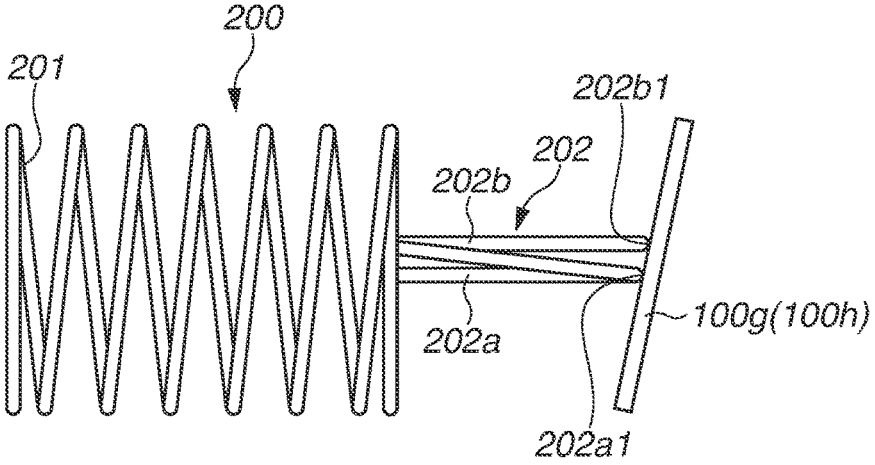
Figure 6C:
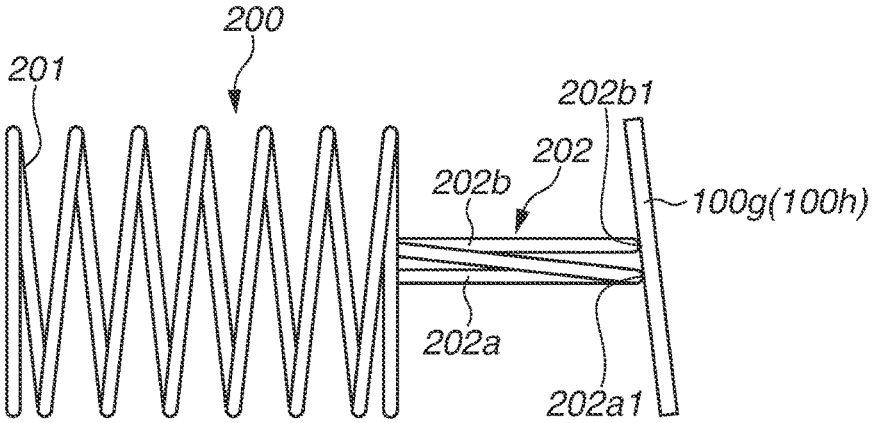

Next, with reference to FIGS. 6A to 6C, a description is given of the state where the process cartridge 100 is inserted into the image forming apparatus 1 main body, and the power reception portion 100*g* or 100*h*, which is provided in the process cartridge 100, is in contact with the ring portion 202 of the electrode 200. FIG. 6A is a diagram illustrating an ideal contact state in a case where the surface of the power reception portion 100*g* or 100*h* of the process cartridge 100 is placed perpendicular to the first axial direction (the left-right direction in FIG. 6A) of the spring portion 201 of the electrode 200.

Consideration is given to the state where the process cartridge 100 is inserted into the image forming apparatus 1 main body, and the spring portion 201 is compressed in the first axial direction (the left direction in FIG. 6A) by the power reception portion 100*g* or 100*h* of the process cartridge 100 via the ring portion 202. In this state, the contact point end portion 202*b*1 of the second ring portion 202*b*, which protrudes further by the amount of protrusion a2, comes into contact with the power reception portion 100*g* or 100*h* of the process cartridge 100 in advance of the contact point end portion 202*a*1 of the first ring portion 202*a*.

The second ring portion 202*b* in contact with the power reception portion 100*g* or 100*h* of the process cartridge 100 is pressed and deforms to the same position as the position of the contact point end portion 202*a*1 of the first ring portion 202*a* by the compressive force of the spring portion 201. Consequently, the power reception portion 100*g* or 100*h* of the process cartridge 100 comes into contact with the first and second ring portions 202*a* and 202*b* together. This enables the electrode 200 to enhance the electrical contact stability and the reliability of a contact point by maintaining a simple configuration. In an actual product, however, the dimensions of each component vary. Thus, it is very difficult to achieve the ideal contact state as illustrated in FIG. 6A.

Next, with reference to FIGS. 6B and 6C, a description is given of a contact state in a case where the surface of the power reception portion 100*g* or 100*h* of the process cartridge 100 is inclined from perpendicular with respect to the first axial direction (the left-right direction in FIGS. 6B and 6C) of the spring portion 201 of the electrode 200.

FIG. 6B is a diagram illustrating the state where the power reception portion 100*g* or 100*h* of the process cartridge 100 is inclined from perpendicular to a direction away from the electrode 200 on the upper side of the image forming apparatus 1 (the upper side in FIG. 6B). Consideration is given to the state where the process cartridge 100 is inserted into the image forming apparatus 1 main body, and the spring portion 201 is compressed by the power reception portion 100*g* or 100*h* of the process cartridge 100.

In this state, as illustrated in FIG. 6B, the contact point end portion 202*a*1 of the first ring portion 202*a* comes into contact with the power reception portion 100*g* or 100*h* of the process cartridge 100 in advance of the contact point end portion 202*b*1 of the second ring portion 202*b*, or the contact point end portion 202*a*1 of the first ring portion 202*a* and the contact point end portion 202*b*1 of the second ring portion

202*b* come into contact with the power reception portion 100*g* or 100*h* of the process cartridge 100 approximately simultaneously.

A contact point of the contact point end portion 202*b*1 of the second ring portion 202*b* at which the contact point end portion 202*b*1 comes into contact with the power reception portion 100*g* or 100*h* of the process cartridge 100 protrudes as follows. This contact point protrudes further in the direction of the power reception portion 100*g* or 100*h* of the process cartridge 100 than a contact point of the contact point end portion 202*a*1 of the first ring portion 202*a* at which the contact point end portion 202*a*1 comes into contact with the power reception portion 100*g* or 100*h* of the process cartridge 100.

Thus, as illustrated in FIG. 6B, there is a case where the power reception portion 100*g* or 100*h* of the process cartridge 100 is away from the electrode 200 on the upper side of the image forming apparatus 1. Even in this case, the power reception portion 100*g* or 100*h* of the process cartridge 100 comes into contact with the contact point end portions 202*a*1 and 202*b*1 of the first and second ring portions 202*a* and 202*b* together. This enables the electrode 200 to enhance the electrical contact stability and the reliability of a contact point by maintaining a simple configuration.

FIG. 6C is a diagram illustrating the state where the power reception portion 100*g* or 100*h* of the process cartridge 100 is inclined from perpendicular to a direction away from the electrode 200 on the lower side of the image forming apparatus 1 (the lower side in FIG. 6C). Consideration is given to the state where the process cartridge 100 is inserted into the image forming apparatus 1 main body, and the spring portion 201 is compressed by the power reception portion 100*g* or 100*h* of the process cartridge 100. In this state, the contact point end portion 202*b*1 of the second ring portion 202*b* comes into contact with the power reception portion 100*g* or 100*h* of the process cartridge 100 in advance of the contact point end portion 202*a*1 of the first ring portion 202*a*.

As illustrated in FIGS. 5A and 5B, the contact point end portion 202*b*1 of the second ring portion 202*b* of the electrode 200 on the process cartridge 100 side protrudes as follows. The contact point end portion 202*b*1 protrudes further in the direction of the power reception portion 100*g* or 100*h* of the process cartridge 100 than the contact point end portion 202*a*1 of the first ring portion 202*a* on the process cartridge 100 side. Further, as illustrated in FIG. 5B, the space b is provided between the first and second ring portions 202*a* and 202*b* in the second axial direction (the left-right direction in FIG. 5B).

The second ring portion 202*b*, of which the contact point end portion 202*b*1 is in contact with the power reception portion 100*g* or 100*h* of the process cartridge 100, is pressed and deforms more greatly than the first ring portion 202*a* by the restoring force caused by the compressive force of the spring portion 201. As illustrated in FIG. 6C, there is a case where the power reception portion 100*g* or 100*h* of the process cartridge 100 is away from the electrode 200 on the lower side of the image forming apparatus 1. Even in this case, the first and second ring portions 202*a* and 202*b* come into contact together with the power reception portions 100*g* or 100*h* of the process cartridge 100.

That is, consideration is given to the state where the contact point end portion 202*b*1 of the second ring portion 202*b* is in contact with the power reception portion 100*g* or 100*h* of the process cartridge 100 as the contact point target portion, and the spring portion 201 is compressed in the axial direction. In this state, the first and second ring portions 202*a* and 202*b* come into contact together with the power reception portion 100*g* or 100*h* (the contact point target portion). This enables the electrode 200 to enhance the electrical contact stability and the reliability of a contact point by maintaining a simple configuration.

Consideration is given to the amount of protrusion a2, illustrated in FIGS. 5A and 5B, of the contact point end portion 202*b*1 of the second ring portion 202*b* of the electrode 200 on the process cartridge 100 side relative to the contact point end portion 202*a*1 of the first ring portion 202*a* on the process cartridge 100 side. In the present exemplary embodiment, due to the limitation of the internal configuration of the image forming apparatus 1, the amount of protrusion a is set to five times the wire diameter d of the steel wire rod forming the electrode 200 or less.

Consideration is given to a case where as illustrated in FIGS. 6A to 6C, the relative angle between the electrode 200 and the power reception portion 100*g* or 100*h* of the process cartridge 100 as the contact point target portion changes. Even in such a case, electrical contact portions (the first and second ring portions 202*a* and 202*b*) can come into contact with the contact point target portion (the power reception portion 100*g* or 100*h*) certainly at two points.

Consideration is given to the state where as illustrated in FIGS. 5A and 5B, the space b is provided between the first and second ring portions 202*a* and 202*b* in the second axial direction (the left-right direction in FIG. 5B), and the first and second ring portions 202*a* and 202*b* are not in contact with the contact point target portion (the power reception portion 100*g* or 100*h*). In this state, consideration is given to the contact point end portion 202*a*1 of the first ring portion 202*a* on the contact point target portion (the power reception portions 100*g* or 100*h*) side and the contact point end portion 202*b*1 of the second ring portion 202*b* on the contact point target portion (the power reception portion 100*g* or 100*h*) side. The configuration is such that the contact point end portion 202*b*1 of the second ring portion 202*b* protrudes further in the direction (the up direction in FIGS. 5A and 5B) of the contact point target portion (the power reception portion 100*g* or 100*h*) than the contact point end portion 202*a*1 of the first ring portion 202*a* by the amount of protrusion a2.

Consideration is given to the state where consequently, as illustrated in FIGS. 6A to 6C, the contact point target portion (the power reception portion 100*g* or 100*h*) is in contact with the contact point end portion 202*b*1 of the second ring portion 202*b* in the state where the spring portion 201 of the electrode 200 is compressed. In this state, the second ring portion 202*b* is pressed and deforms by the restoring force caused by the compressive force of the spring portion 201. Consequently, the contact point target portion (the power reception portion 100*g* or 100*h*) comes into contact with the contact point end portion 202*a*1 of the first ring portion 202*a*, and the contact point target portion (the power reception portion 100*g* or 100*h*) also comes into contact with the contact point end portion 202*b*1 of the second ring portion 202*b*. This enables the electrode 200 to enhance the electrical contact stability and the reliability of a contact point by maintaining a simple configuration.

Figure 7A:
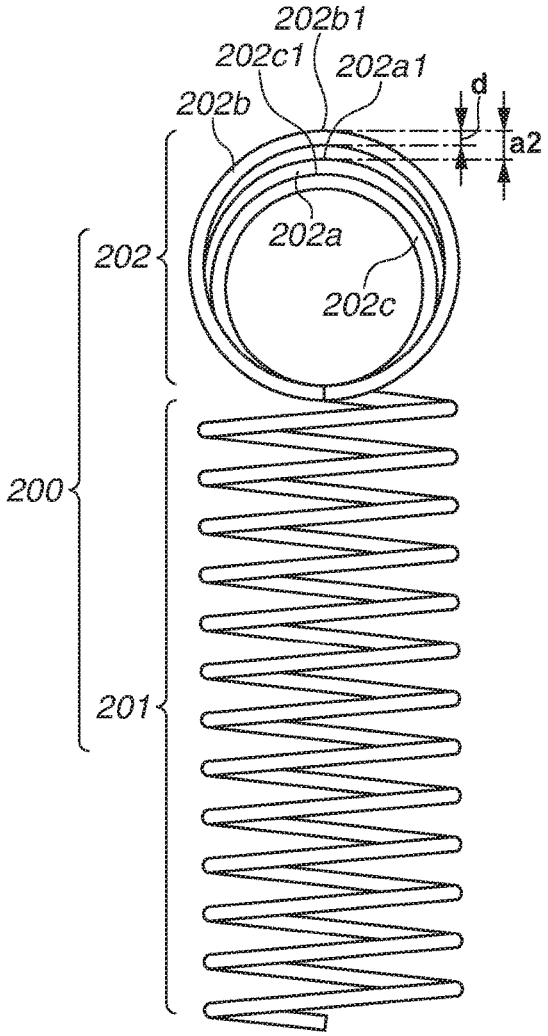
FIG. 7A is a front view illustrating a configuration of an electrode according to a second exemplary embodiment.
Figure 7B:
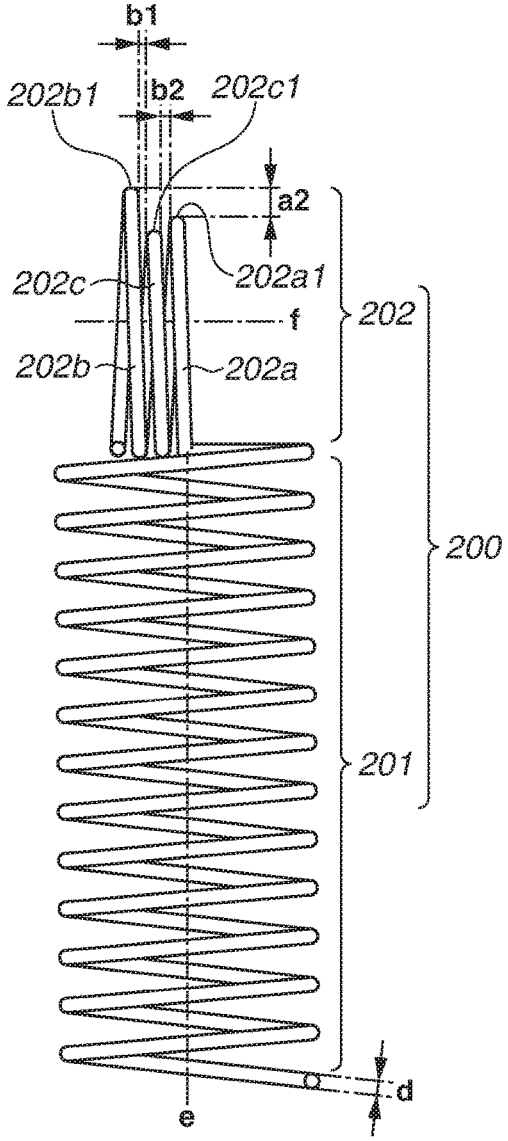
FIG. 7B is a side view illustrating the configuration of the electrode according to the second exemplary embodiment.

Next, with reference to FIGS. 7A and 7B, the configuration of a second exemplary embodiment of the image forming apparatus including the electrode is described. Components similar to those of the first exemplary embodiment are designated by the same numerals or the same member names even with different numerals, and are not described here. FIG. 7A is a front view illustrating the configuration of an electrode according to the second exemplary embodiment. FIG. 7B is a side view illustrating the configuration of the electrode according to the second exemplary embodiment.

In the first exemplary embodiment, an example has been described where as illustrated in FIGS. 5A and 5B, two ring portions, namely the first and second ring portions 202*a* and 202*b*, are provided on the process cartridge 100 side of the electrode 200. In the present exemplary embodiment, an example is described where as illustrated in FIGS. 7A and 7B, three ring portions, namely first, second, and third ring portions 202*a*, 202*b*, and 202*c*, are provided on the process cartridge 100 side of the electrode 200.

The ring portion 202 according to the present exemplary embodiment includes a third ring portion 202*c*, which is connected between the first and second ring portions 202*a* and 202*b* in the second axial direction. A second space b2 is provided between the first and third ring portions 202*a* and 202*c* in the second axial direction (the left-right direction in FIG. 7B) of the ring portion 202. Further, a third space b1 is provided between the second and third ring portions 202*b* and 202*c* in the second axial direction (the left-right direction in FIG. 7B) of the ring portion 202. The second and third spaces b2 and b1 are set to be larger than the wire diameter d of the steel wire rod (the outer diameter of the wire rod) forming the electrode 200.

Consideration is given to the state where as illustrated in FIGS. 7A and 7B, the ring portion 202 of the electrode 200 is not in contact with the power reception portion 100*g* or 100*h* (the contact point target portion) of the process cartridge 100. In this state, consideration is given to the contact point end portion 202*a*1 of the first ring portion 202*a* on the process cartridge 100 side (the contact point target portion side) and an end portion 202*c*1 of the third ring portion 202*c* on the process cartridge 100 side (the contact point target portion side). The end portion 202*c*1 of the third ring portion 202*c* is further retracted to the spring portion 201 side (the spring portion side) than the contact point end portion 202*a*1 of the first ring portion 202*a* is.

That is, the contact point end portion 202*b*1 of the second ring portion 202*b* is the closest to the power reception portion 100*g* or 100*h* of the process cartridge 100. The contact point end portion 202*a*1 of the first ring portion 202*a* is the second closest to the power reception portion 100*g* or 100*h* of the process cartridge 100. The end portion 202*c*1 of the third ring portion 202*c* is placed at the furthest position from the power reception portion 100*g* or 100*h* of the process cartridge 100.

Consideration is given to the amount of protrusion a2, illustrated in FIGS. 7A and 7B, of the contact point end portion 202*b*1 of the second ring portion 202*b* on the process cartridge 100 side relative to the contact point end portion 202*a*1 of the first ring portion 202*a* on the process cartridge 100 side. The amount of protrusion a is set to be larger than the wire diameter d of the steel wire rod forming the electrode 200.

Further, the space b1 between the second and third ring portions 202*b* and 202*c* in the second axial direction (the left-right direction in FIG. 7B) of the ring portion 202 is set to be larger than the wire diameter d of the steel wire rod forming the electrode 200. Further, the space b2 between the first and third ring portions 202*a* and 202*c* in the second axial direction (the left-right direction in FIG. 7B) of the ring portion 202 is also set to be larger than the wire diameter d of the steel wire rod forming the electrode 200.

Consequently, even in a case where the restoring force caused by the compressive force of the spring portion 201 is weaker than that in the first exemplary embodiment, the second ring portion 202*b* can easily deform via the third ring portion 202*c*. Consequently, the contact point end portion 202*a*1 of the first ring portion 202*a* and the contact point end portion 202*b*1 of the second ring portion 202*b* come into contact together with the power reception portion 100*g* or 100*h* of the process cartridge 100. This enables the electrode 200 to enhance the electrical contact stability and the reliability of a contact point by maintaining a simple configuration.

In the present exemplary embodiment, an example has been described where the second ring portion 202*b* of the electrode 200 is placed on the upper side (the left side in FIG. 7B) of the image forming apparatus 1. The directions of optimal placement of the first and second ring portions 202*a* and 202*b* of the electrode 200 appropriately change according to the frame configuration of the image forming apparatus 1 or the configuration of the process cartridge 100.

In the above exemplary embodiments, the image forming apparatus 1 has been described as an example of a laser printer. The present disclosure, however, is not limited to this. Alternatively, it is also possible to obtain similar effects by applying the image forming apparatus 1 to another image forming apparatus such as a copying machine. Another image forming apparatus is configured similarly to the first exemplary embodiment and can obtain similar effects.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Applications No. 2017-034886, filed Feb. 27, 2017, and No. 2017-220208, filed Nov. 15, 2017, which are hereby incorporated by reference herein in their entirety.

What is claimed is:

1. An electrode comprising:

an elastically deformable spring portion formed cylindrically by winding a conductive wire rod into a helix; and a ring portion provided on one end of the spring portion, in a first axial direction, obtained by annularly winding the conductive wire rod in a second axial direction intersecting the first axial direction, wherein the ring portion includes, in the second axial direction:

a first ring connected to the spring portion; and a second ring connected to the first ring, wherein in a state where the ring portion is not in contact with a contact point target, a contact point end portion of the second ring on the contact point target side, protrudes further in a direction of the contact point target than a contact point end portion of the first ring on the contact point target side, and wherein in a state where the contact point end portion of the second ring is in contact with the contact point target, and the spring portion is compressed in the first axial direction, both the contact point end portion of the first ring and the contact point end portion of the second ring come into contact with the contact point target.

2. The electrode according to claim 1, wherein a space is provided between the first ring and second ring in the second axial direction of the ring portion.

3. The electrode according to claim 2, wherein the space is larger than an outer diameter of the wire rod.

4. The electrode according to claim 1, wherein an amount of protrusion by which the contact point end portion of the second ring protrudes further in the direction of the contact point target than the contact point end portion of the first ring, is larger than an outer diameter of the wire rod.

5. The electrode according to claim 1, wherein the ring portion includes, in the second axial direction, a third ring connected between the first ring and second ring, and wherein in a state where the ring portion is not in contact with the contact point target, an end portion of the third ring on the contact point target portion side is further retracted to the spring portion side than is the contact point end portion of the first ring.

6. The electrode according to claim 5, wherein a second space is provided between the first ring and the third ring in the second axial direction of the ring portion, and wherein a third space is provided between the second ring and the third ring in the second axial direction of the ring portion.

7. The electrode according to claim 6, wherein at least one of the second and third spaces is larger than an outer diameter of the wire rod.

8. The electrode according to claim 1, wherein in a state where the ring portion is in contact with the contact point target, a contact portion of the ring portion and the contact point target are exposed to outside of the ring portion.

9. An image forming apparatus in which a cartridge including at least an image bearing member and a charging unit configured to charge the image bearing member is provided to be attachable to and detachable from the image forming apparatus, the image forming apparatus comprising an electrode including, an elastically deformable spring portion formed cylindrically by winding a conductive wire rod into a helix, and a ring portion provided on one end of the spring portion, in a first axial direction, obtained by annularly winding the conductive wire rod in a second axial direction intersecting the first axial direction, wherein the ring portion includes, in the second axial direction:

a first ring connected to the spring portion; and a second ring connected to the first ring, wherein in a state where the ring portion is not in contact with a contact point target, a contact point end portion of the second ring on the contact point target side, protrudes further in a direction of the contact point target than a contact point end portion of the first ring on the contact point target side, wherein in a state where the contact point end portion of the second ring is in contact with the contact point target, and the spring portion is compressed in the first axial direction, both the contact point end portion of the first ring and the contact point end portion of the second ring come into contact with the contact point target, and wherein the contact point target is a power reception portion configured to receive power to be supplied to the charging unit.

10. An image forming apparatus in which a cartridge including at least a developing unit configured to supply a developer to an electrostatic latent image formed on an image bearing member is provided to be attachable to and detachable from the image forming apparatus, the image forming apparatus comprising an electrode including, an elastically deformable spring portion formed cylindrically by winding a conductive wire rod into a helix, and a ring portion provided on one end of the spring portion, in a first axial direction, obtained by annularly winding the conductive wire rod in a second axial direction intersecting the first axial direction, wherein the ring portion includes, in the second axial direction:

a first ring connected to the spring portion; and a second ring connected to the first ring, wherein in a state where the ring portion is not in contact with a contact point target, a contact point end portion of the second ring on the contact point target side, protrudes further in a direction of the contact point target than a contact point end portion of the first ring on the contact point target side, wherein in a state where the contact point end portion of the second ring is in contact with the contact point target, and the spring portion is compressed in the first axial direction, both the contact point end portion of the first ring and the contact point end portion of the second ring come into contact with the contact point target, and wherein the contact point target is a power reception portion configured to receive power to be supplied to the developing unit.

11. An image forming apparatus in which a first cartridge including at least an image bearing member and a charging unit configured to charge the image bearing member, and a second cartridge including a developing unit configured to supply a developer to an electrostatic latent image formed on the image bearing member are provided to be attachable to and detachable from the image forming apparatus, the image forming apparatus comprising two electrodes each including, an elastically deformable spring portion formed cylindrically by winding a conductive wire rod into a helix, and a ring portion provided on one end of the spring portion, in a first axial direction, obtained by annularly winding the conductive wire rod in a second axial direction intersecting the first axial direction, wherein the ring portion includes, in the second axial direction:

a first ring connected to the spring portion; and a second ring connected to the first ring, wherein in a state where the ring portion is not in contact with a contact point target, a contact point end portion of the second ring on the contact point target side, protrudes further in a direction of the contact point target than a contact point end portion of the first ring on the contact point target side, wherein in a state where the contact point end portion of the second ring is in contact with the contact point target, and the spring portion is compressed in the first axial direction, both the contact point end portion of the first ring and the contact point end portion of the second ring come into contact with the contact point target, wherein the ring portion of a first electrode of the two electrodes comes into contact with a first contact point target including a power reception portion configured to receive power to be supplied to the charging unit provided in the first cartridge, and wherein the ring portion of a second electrode of the two electrodes comes into contact with a second contact point target including a power reception portion configured to receive power to be supplied to the developing unit provided in the second cartridge.

12. The image forming apparatus according to claim 11, wherein the first and second cartridges are provided to be independently attachable to and detachable from a main body of the image forming apparatus.

13. An electrode comprising:

an elastically deformable spring portion formed cylindrically by winding a conductive wire rod into a helix; and a ring portion provided on one end of the spring portion, in a first axial direction, obtained by annularly winding the conductive wire rod in a second axial direction intersecting the first axial direction, wherein the ring portion includes, in the second axial direction:

a second ring connected to the spring portion; and a first ring connected to the second ring, wherein in a state where the ring portion is not in contact with a contact point target, a contact point end portion of the first ring on the contact point target side, protrudes further in a direction of the contact point target than a contact point end portion of the second ring on the contact point target side, and wherein in a state where the contact point end portion of the first ring is in contact with the contact point target, and the spring portion is compressed in the first axial direction, both the contact point end portion of the second ring and the contact point end portion of the first ring come into contact with the contact point target.

14. An image forming apparatus in which a cartridge including at least an image bearing member and a charging unit configured to charge the image bearing member is provided to be attachable to and detachable from the image forming apparatus, the image forming apparatus comprising an electrode including, an elastically deformable spring portion formed cylindrically by winding a conductive wire rod into a helix, and a ring portion provided on one end of the spring portion, in a first axial direction, obtained by annularly winding the conductive wire rod in a second axial direction intersecting the first axial direction, wherein the ring portion includes, in the second axial direction:

a second ring connected to the spring portion; and a first ring connected to the second ring, wherein in a state where the ring portion is not in contact with a contact point target, a contact point end portion of the first ring on the contact point target side, protrudes further in a direction of the contact point target than a contact point end portion of the second ring on the contact point target side, wherein in a state where the contact point end portion of the first ring is in contact with the contact point target, and the spring portion is compressed in the first axial direction, both the contact point end portion of the second ring and the contact point end portion of the first ring come into contact with the contact point target, and wherein the contact point target is a power reception portion configured to receive power to be supplied to the charging unit.

* * * * *